US010576742B2

(12) United States Patent
Kihira et al.

(10) Patent No.: US 10,576,742 B2
(45) Date of Patent: Mar. 3, 2020

(54) LIQUID DISCHARGE HEAD AND LIQUID DISCHARGE APPARATUS

(71) Applicants: Takakazu Kihira, Ibaraki (JP); Tomoaki Murakami, Ibaraki (JP); Masami Iwama, Ibaraki (JP); Kouichi Nakano, Ibaraki (JP)

(72) Inventors: Takakazu Kihira, Ibaraki (JP); Tomoaki Murakami, Ibaraki (JP); Masami Iwama, Ibaraki (JP); Kouichi Nakano, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/157,238

(22) Filed: Oct. 11, 2018

(65) Prior Publication Data

US 2019/0224974 A1 Jul. 25, 2019

(30) Foreign Application Priority Data

Jan. 19, 2018 (JP) ..... 2018-007437
Aug. 29, 2018 (JP) ..... 2018-160110

(51) Int. Cl.
*B41J 2/14* (2006.01)

(52) U.S. Cl.
CPC ..... *B41J 2/14233* (2013.01); *B41J 2/14274* (2013.01); *B41J 2002/14403* (2013.01)

(58) Field of Classification Search
CPC ..... B41J 2/14233; B41J 2/14201; B41J 2/16274; B41J 2/14209
See application file for complete search history.

(56) References Cited

U.S. PATENT DOCUMENTS 8,534,805 B2 * 9/2013 Sano ..... B41J 2/14274
2015/0062255 A1 3/2015 Sasaki
2018/0272743 A1 9/2018 Nakai et al.

FOREIGN PATENT DOCUMENTS

JP 2001-293864 10/2001
JP 2001-293865 10/2001
JP 2015-071289 4/2015
JP 2016-128270 7/2016
JP 2017-119439 7/2017
JP 2017-159673 9/2017

* cited by examiner

*Primary Examiner* — Juanita D Jackson
(74) *Attorney, Agent, or Firm* — Oblon, McClelland, Maier & Neustadt, L.L.P.

(57) ABSTRACT

A liquid discharge head includes a nozzle plate in which a plurality of nozzles to discharge a liquid is formed in a nozzle array direction, a channel plate including partition walls to form a plurality of individual chambers communicating with the plurality of nozzles, respectively, a diaphragm bonded to the channel plate to form a wall of the plurality of individual chambers, and a plurality of electromechanical transducers bonded to the diaphragm to deform the diaphragm to generate a pressure in the plurality of individual chambers, and a cycle of vibration of natural vibration generated in the liquid in the plurality of individual chambers is equal to or larger than a cycle of a primary mode of lateral vibration of the plurality of electromechanical transducers in the nozzle array direction.

6 Claims, 15 Drawing Sheets

LIQUID DISCHARGE HEAD AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-007437, filed on Jan. 19, 2018, and Japanese Patent Application No. 2018-160110, filed on Aug. 29, 2018, in the Japan Patent Office, the entire disclosure of each of which is hereby incorporated by reference herein.

BACKGROUND

Technical Field

Aspects of the present disclosure relate to a liquid discharge head and a liquid discharge apparatus.

Related Art

In an inkjet head including laminated piezoelectric elements, the piezoelectric elements are disposed so that the directions of expansion and contraction of the piezoelectric elements are matched to face nozzles, respectively. The inkjet head is also referred to as a liquid discharge head or a droplet discharge head. The inkjet head applies drive signals to the piezoelectric element to expand and contract the piezoelectric element to apply pressure to ink and discharges ink droplets from the nozzle.

However, the discharge speed of ink droplets varies among nozzles in the inkjet head using laminated piezoelectric elements. In particular, the discharge speed of ink droplets discharged from nozzles varies due to variation of frequency characteristics between neighboring piezoelectric elements. Thus, it is difficult to obtain uniform discharge characteristics in the inkjet head.

SUMMARY

In an aspect of this disclosure, a novel liquid discharge head includes a nozzle plate in which a plurality of nozzles to discharge a liquid is formed in a nozzle array direction, a channel plate including partition walls to form a plurality of individual chambers communicating with the plurality of nozzles, respectively, a diaphragm bonded to the channel plate to form a wall of the plurality of individual chambers, and a plurality of electromechanical transducers bonded to the diaphragm to deform the diaphragm to generate a pressure in the plurality of individual chambers. A longitudinal direction of the plurality of individual chambers is disposed in a direction perpendicular to the nozzle array direction, and a cycle of vibration of natural vibration generated in the liquid in the plurality of individual chambers is equal to or larger than a cycle of a primary mode of lateral vibration of the plurality of electromechanical transducers in the nozzle array direction.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
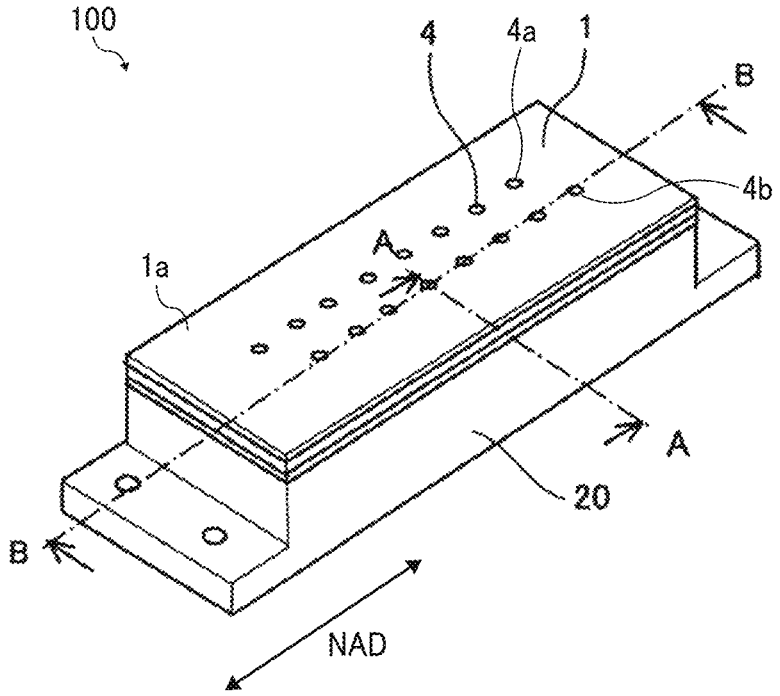
FIG. 1 is an outer perspective view of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Next, a liquid discharge apparatus according to an embodiment of the present disclosure is described with reference to drawings. The present disclosure may be modified within a range that can be conceived by those skilled in the art. The modification includes such as substitution to other embodiments, additions, modifications, or deletions. The modified present disclosure is included in the scope of the present disclosure as long as the functions and effects of the present disclosure are exhibited. Further, some of description and drawings may be appropriately omitted or simplified in order to clarify the description. In each of the drawings, the same reference codes are allocated to components or portions having the same configuration, and redundant descriptions of the same components may be omitted.

Figure 2:
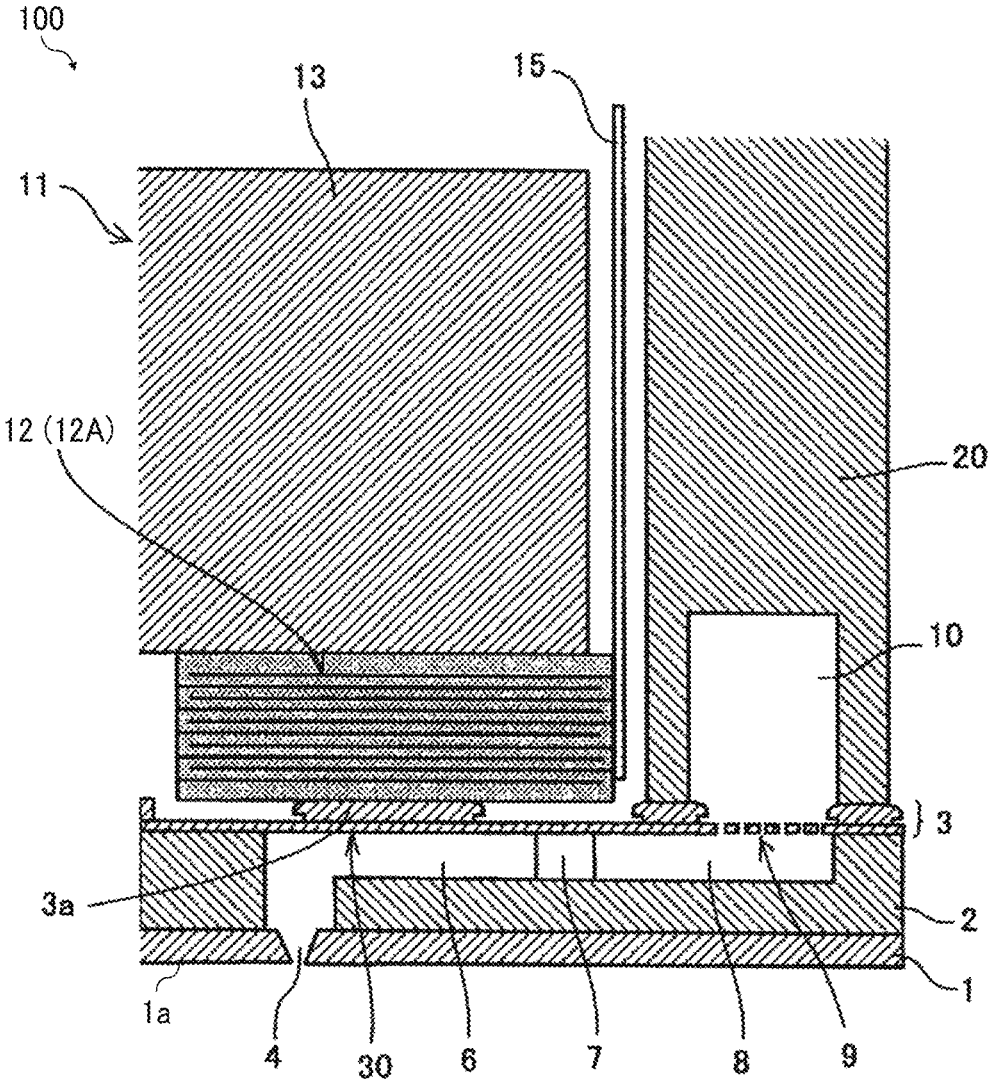
FIG. 2 is a cross-sectional view of the liquid discharge head cut along a line A-A indicated in FIG. 1 in a direction perpendicular to a nozzle array direction in which nozzles are arrayed in row.
Figure 3:
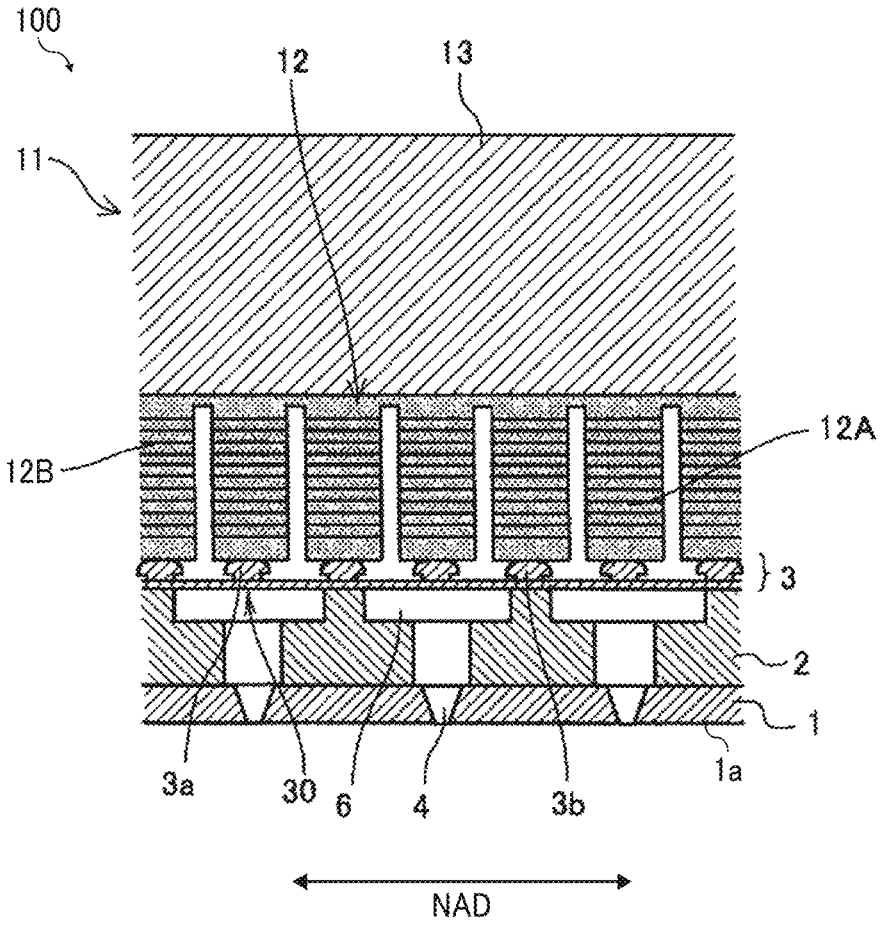
FIG. 3 is a cross-sectional view of the head cut along a line B-B of FIG. 1 in the nozzle array direction that is along a transverse direction of the individual chamber.

A liquid discharge head 100 according to a first embodiment of the present disclosure is described with reference to FIGS. 1 to 3. In the following description, the "liquid discharge head" is simply referred to as "head". FIG. 1 is a schematic perspective view of exterior of the head. FIG. 2 is a cross-sectional view of the head cut along a line A-A indicated in FIG. 1 in a direction perpendicular to a nozzle array direction in which nozzles are arrayed in row. The nozzle array direction is indicated by NAD in FIGS. 1 and 3. The direction perpendicular to the nozzle array direction NAD is a longitudinal direction of an individual chamber in the head 100. FIG. 3 is a cross-sectional view of the head cut along a line B-B of FIG. 1 in the nozzle array direction NAD that is along a transverse direction of the individual chamber.

The head 100 includes a nozzle plate 1, a channel plate 2 (liquid chamber substrate), and a diaphragm 3 as a thin-film member that are laminated one on another and bonded to each other. Further, the head 100 includes a piezoelectric actuator 11 to displace the diaphragm 3 and a frame 20 as a common channel member that configures the frame 20 of the head 100.

The nozzle plate 1, the channel plate 2, and the diaphragm 3 constitute individual chambers 6, fluid restrictors 7, and liquid introduction portions 8. The individual chambers 6 are communicated with nozzles 4, respectively. The liquid is discharged from the nozzles 4. The fluid restrictors 7 supply the liquid to the individual chambers 6, respectively. The liquid introduction portions 8 are communicated with the fluid restrictors 7, respectively. The individual chamber 6 is also referred to as a liquid chamber, a pressure individual chamber, a pressure chamber, a pressurizing chamber, a channel, or the like.

The head 100 includes a common chamber 10 serving as a common channel formed in the frame 20 and a filter 9 formed in the diaphragm 3. The liquid is supplied to the individual chambers 6 from the common chamber 10 via the filter 9, the liquid introduction portions 8, and the fluid restrictors 7.

The nozzle plate 1 is formed of a metal plate of nickel (Ni) and produced by electroforming. However, the material of the nozzle plate 1 is not limited to Ni. In some embodiments, other metal member, a resin member, or a member including a plurality of layers of resin and metal may be used for forming the nozzle plate 1. The nozzles 4 having a diameter in a range from 10 to 35 μm are formed in the nozzle plate 1 such that positions of the nozzles 4 correspond to positions of the individual chambers 6, respectively. The nozzle plate 1 is adhesively bonded to the channel plate 2. The head 100 includes two nozzle arrays 4*a* and 4*b* each including nozzles 4 arranged in a row in the nozzle array direction. Further, a water repellent layer is formed on a nozzle surface 1*a* of the nozzle plate 1 from which the liquid is discharged. The nozzle surface 1*a* is a discharge surface in a discharge direction of the liquid and is a surface opposite to the channel plate 2 in which the individual chambers 6 are formed (see FIG. 3).

The channel plate 2 is formed by etching a single crystal silicon substrate to form grooves constituting the individual chambers 6, the fluid restrictors 7, the liquid introduction portions 8, and the like. The channel plate 2 may also be formed by etching a metal plate such as an SUS substrate with an acid etching solution or by performing a machining process such as a press machine.

The diaphragm 3 also serves as a wall forming a wall surface of the individual chamber 6 of the channel plate 2 and has a deformable vibration area 30 in a portion corresponding to the individual chamber 6.

The piezoelectric actuator 11 includes an electromechanical conversion element as a driving member (an actuator or a pressure generator). The piezoelectric actuator 11 deforms the vibration area 30 of the diaphragm 3. The piezoelectric actuator 11 is disposed on the side opposite to the individual chamber 6 of the diaphragm 3.

The piezoelectric actuator 11 includes a plurality of laminated piezoelectric members 12 bonded on a base 13. The piezoelectric member 12 is groove-processed by half cut dicing so that the piezoelectric actuator 11 includes a desired number of drive pillars 12A and support pillars 12B arranged at certain intervals in the shape of a comb (see FIG. 3).

The drive pillars 12A and the support pillars 12B of the piezoelectric members 12 have the same structure. In the present embodiment, the drive pillars 12A of the piezoelectric member 12 are driven by application of drive waveforms, and the support pillars 12B are used as supports to which no drive waveform is applied.

The drive pillars 12A are joined (bonded) to convex portions 3*a*, respectively. The convex portions 30*a* are thick portions having an island-like form formed on the vibration area 30 of the diaphragm 3. The support pillars 12B are joined (bonded) to the convex portions 30*b*, respectively. The convex portions 30*b* are thick portions of the diaphragm 3.

The piezoelectric members 12 include piezoelectric layers and internal electrodes alternately laminated on each other. Each internal electrode is extended to an end surface of the drive pillar 12A or the support pillar 12B to form an external electrode. The flexible printed circuit (FPC) 15 as a flexible wiring member is connected to the external electrodes of the drive pillars 12A to apply drive signals to the drive pillars 12A.

The frame 20 may be formed by injection-molding of a thermosetting resin (e.g., epoxy resin) or polyphenylene sulfate, for example. The frame 20 includes the common chamber 10 to which the liquid is supplied from a head tank and a liquid cartridge.

In the head 100 thus configured, for example, when a voltage lower than a reference potential is applied to the drive pillar 12A, the drive pillar 12A contracts. Accordingly, the vibration area 30 of the diaphragm 3 is pulled and the volume of the individual chamber 6 increases, thus causing liquid to flow into the individual chamber 6. When the voltage applied to the drive pillar 12A is raised, the drive pillar 12A expands in the direction of lamination. The vibration area 30 of the diaphragm 3 deforms in a direction toward the nozzle 4 and contracts the volume of the individual chamber 6. As a result, the liquid in the individual chamber 6 is pressurized, and the liquid is discharged (injected) from the nozzle 4.

When the voltage applied to the drive pillar 12A is returned to the reference potential, the vibration area 30 of the diaphragm 3 is returned to an initial position. Accordingly, the individual chamber 6 expands to generate a negative pressure, thus replenishing the liquid from the common chamber 10 into the individual chamber 6 via the fluid restrictor 7. After a vibration of a meniscus surface of the liquid in the nozzle 4 is attenuated and stabilized, an operation for the next liquid discharge is started.

Note that the method of driving the head 100 is not limited to the above-described example (pull-push discharge). For example, pull discharge or push discharge may be performed in accordance with the way to apply a drive waveform.

Figure 4:
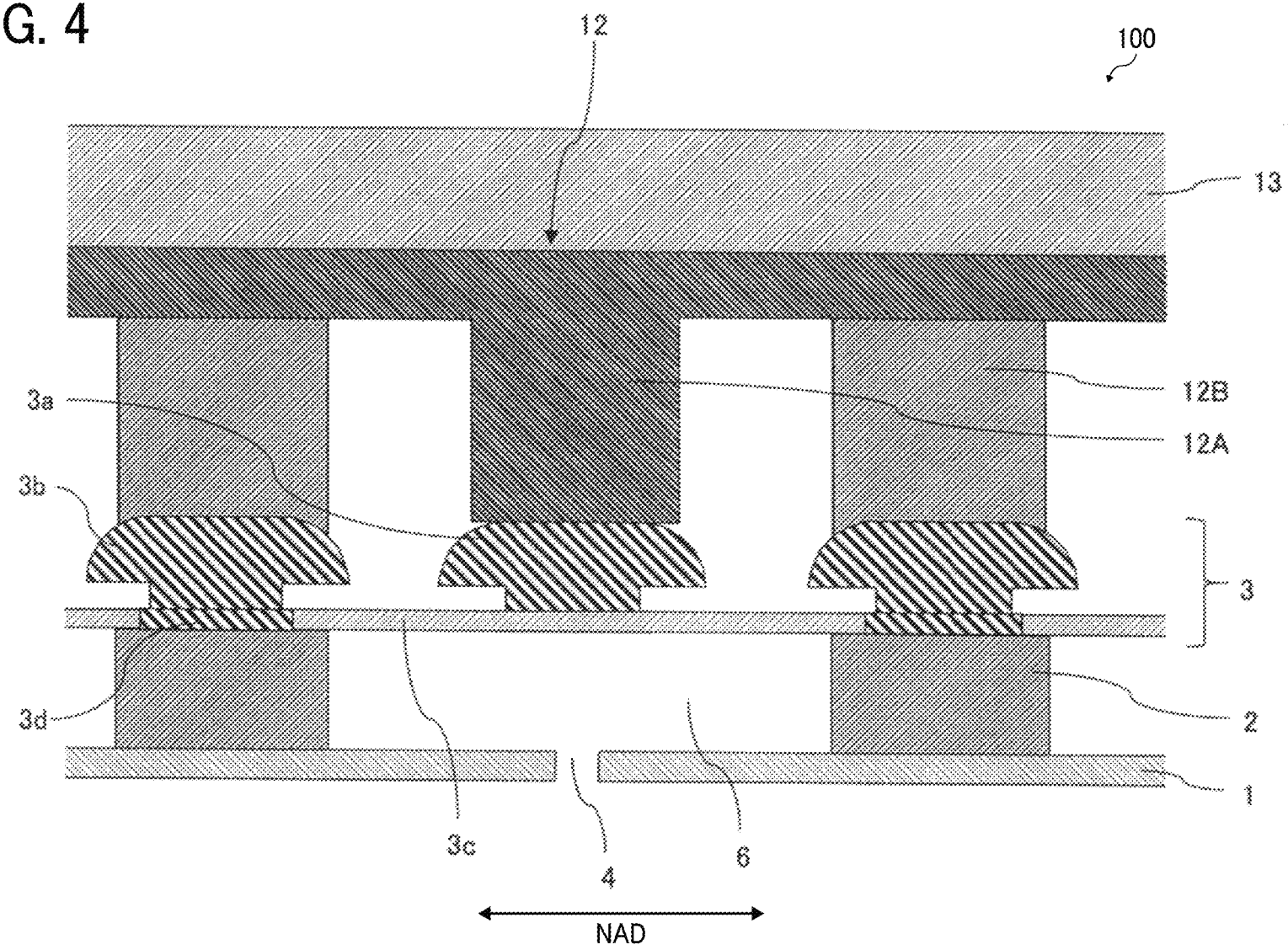
FIG. 4 is cross-sectional view of the head along the nozzle array direction (transverse direction of the individual chamber)
Figure 5:
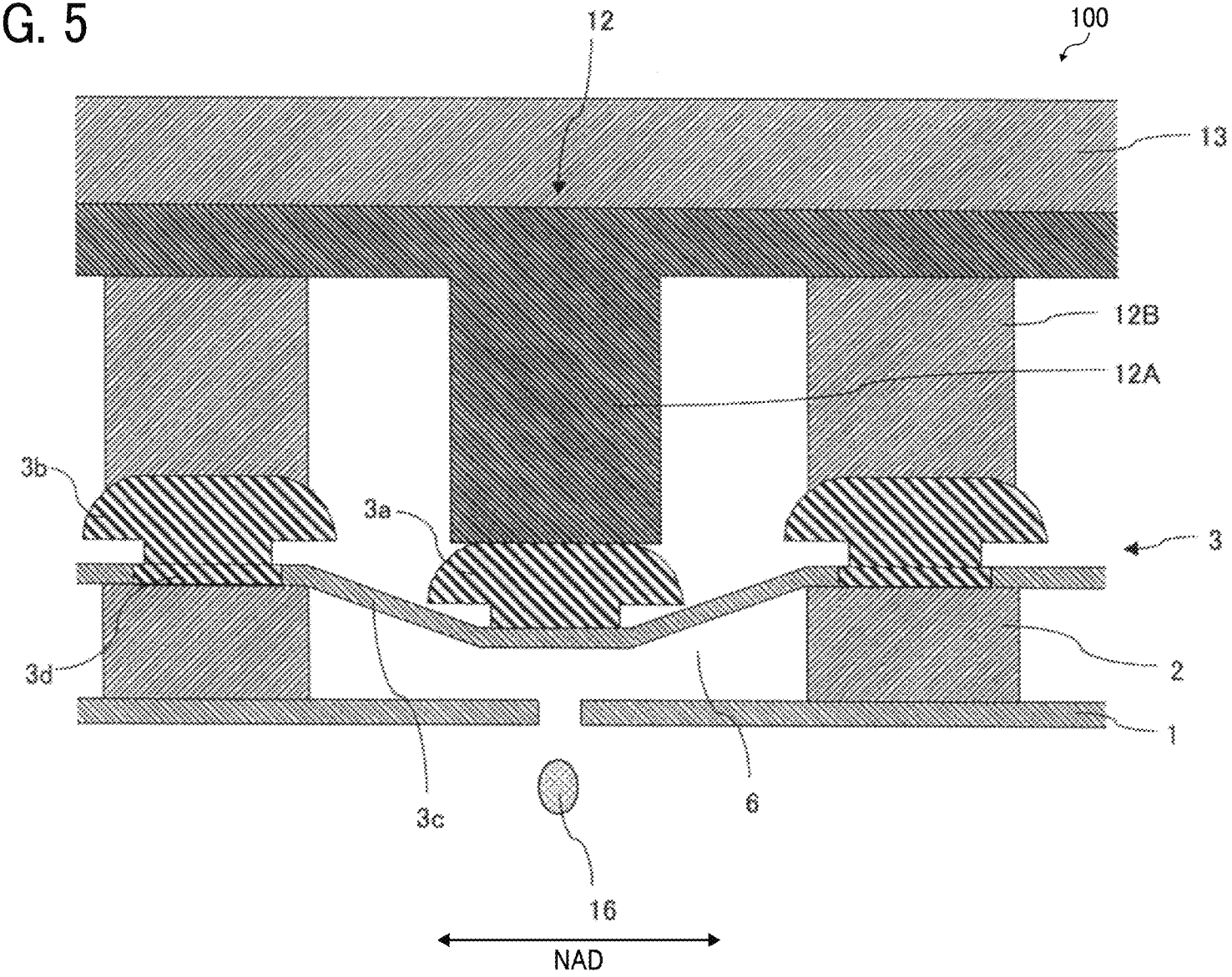
FIG. 5 is a cross-sectional view of the head along the nozzle array direction (transverse direction of the individual chamber) when the head is driven.

Details of the diaphragm 3 and the piezoelectric member 12 are described below with reference to FIGS. 4 and 5. FIG. 4 is a schematic cross-sectional view of the head 100 according to the present embodiment in the nozzle array direction NAD of the head 100. The nozzle array direction NAD is along a transverse direction of the individual chamber 6 that is perpendicular to a longitudinal direction of the individual chamber 6. FIG. 5 is a schematic cross-sectional view of the head 100 in the nozzle array direction NAD (transverse direction of individual chamber 6) of the head 100. FIG. 5 illustrates a state in which the voltage is applied to the drive pillar 12A of the head 100.

FIG. 4 illustrates the nozzle plate 1, the channel plate 2, the diaphragm 3, the piezoelectric member 12, the base 13 and the like in the same manner as described above. The individual chambers 6 are formed in the channel plate 2. The piezoelectric member 12 includes the drive pillars 12A that generate pressure in the individual chambers 6 and the support pillars 12B disposed on partition walls of the individual chambers 6. As described above, the drive pillars 12A are joined (bonded) to the island-shaped convex portions 3*a* formed in the vibration area 30 of the diaphragm 3, respectively. The support pillars 12B are joined (bonded) to the convex portions 3*b* of the diaphragm 3, respectively.

As illustrated in FIG. 5, when the voltage is applied to the drive pillar 12A to drive the drive pillar 12A, a drive portion 3*c* of the diaphragm 3 is deformed to generate pressure in the individual chamber 6. Thus, the liquid in the individual chamber 6 is discharged from the nozzle 4 as a droplet 16.

In FIG. 5, the diaphragm 3 includes the drive portion 3*c* and a non-drive portion 3*d*. The drive portion 3*c* generates the pressure in the individual chamber 6. The non-drive portion 3*d* is an area other than the drive portion 3*c* in the diaphragm 3. Further, the drive portion 3*c* and the non-drive portion 3*d* are made of different metals, and the drive portion 3*c* preferably has lower hardness than the non-drive portion 3*d*.

Making the drive portion 3*c* and the non-drive portion 3*d* with different metals and making the hardness of the drive portion 3*c* to be lower than the hardness of the non-drive portion 3*d* can decrease the hardness of the drive portion 3*c* without reducing a film thickness of the diaphragm 3. Thus, the head 100 according to the present embodiment can maintain the hardness of the diaphragm 3. Further, the diaphragm 3 of the head 100 can sufficiently displace without reducing the film thickness of the diaphragm 3 even if the density of the nozzles 4 is increased and the width of the diaphragm 3 is narrowed. Further, the present embodiment can prevent discharge process in one nozzle 4 (individual chamber 6) from affecting the discharge process in an adjacent nozzle 4 (individual chamber 6).

As illustrated in FIGS. 4 and 5, the convex portions 3*a* and 3*b* are formed on the drive portion 3*c* and the non-drive portion 3*d* of the diaphragm 3, respectively, on a side of the diaphragm 3 at which the piezoelectric member 12 (electromechanical transducer element) is disposed. The convex portions 3*a* face the drive pillars 12A and the convex portions 3*b* face the support pillars 12B. Each of the convex portions 3*a* and 3*b* has an overhang shape. The convex portion 3*a* is disposed to face the drive pillar 12A of the piezoelectric member 12. Similarly, the convex portion 3*b* disposed to face the support pillar 12B of the piezoelectric member 12.

Next, dimensional specification of the piezoelectric member 12 (electromechanical transducer element) of the present embodiment is described below.

Here, the piezoelectric member 12 (electromechanical transducer element) is an example of a pressure generator that generates a pressure in the individual chamber 6 communicating with the nozzle 4 from which the liquid is discharged via the diaphragm 3 in the head 100. The liquid is discharged from the nozzle 4 by the pressure generated by the pressure generator.

In the following description, the piezoelectric member 12 (laminated piezoelectric element) is used as an example of the electromechanical conversion element. In this specification, the piezoelectric member is also referred to as a piezoelectric element.

A dimension of pillar of the piezoelectric member 12 is determined from a viewpoint of dimensional specification of the piezoelectric member 12 for stable discharge performance at high frequencies, a displacement efficiency of the piezoelectric member 12 (laminated piezoelectric element), and a productivity in manufacturing the piezoelectric member 12.

For example, when a lateral vibration of the piezoelectric member 12 becomes shorter than a meniscus period, the lateral vibration of the piezoelectric member 12 is excited, and the lateral vibration remains without being attenuated. Thus, the diaphragm 3 is influenced by the lateral vibration and does not stably displace at high frequencies.

However, preferably, the head 100 stably discharge the liquid at high frequencies to further improve discharge performance (productivity improvement) of the head 100.

Further, it is found that the lateral vibration of the piezoelectric member 12 in a transverse direction of the diaphragm 3 (specifically, the island-shaped convex portions 3*a* and 3*b*) of the head 100 affects the discharge performance of the head 100 at high frequencies. The transverse direction of the diaphragm 3 is along the nozzle array direction NAD of the head 100.

The influence of lateral vibration of the piezoelectric member 12 is described below. (1) The influence of lateral vibration of the piezoelectric member 12 becomes remarkable when a bonding position between the piezoelectric member 12 and the diaphragm 3 is shifted from a design position. (2) When a cycle of the lateral vibration is longer than a cycle of meniscus (meniscus cycle), a beat (oscillation) is generated by the meniscus cycle and the cycle of the lateral vibration. When the cycle of the lateral vibration is longer than a cycle of meniscus, a frequency of the lateral vibration is smaller than a frequency of the meniscus. Especially, the frequency of the lateral vibration is about 20 kHz smaller than the frequency of the meniscus in the head 100. Thus, the discharge performance of the head 100 at high frequencies varies and is deteriorated.

Further, when the cycle of the lateral vibration is equal or shorter than the meniscus cycle, the influence of the beat (oscillation) becomes smaller and the frequency of the lateral vibration becomes higher. That is, the rigidity of the structure of the piezoelectric member 12 increases because an aspect ratio (ratio of height to width) of the piezoelectric member 12 decreases and the piezoelectric member 12 becomes thick and short as a pillar. Thus, the attenuation of the residual vibration of the piezoelectric member 12 became faster. Therefore, the residual vibration of the piezoelectric member 12 does not influence the discharge performance of the head 100.

According to the above-described analysis, the dimension of the piezoelectric member 12 of the head 100 according to the present embodiment is adjusted such that a cycle of a primary mode of the lateral vibration of the piezoelectric member 12 (laminated piezoelectric element) is shorter than the meniscus cycle of the nozzle 4 to suppress the residual vibration. The primary mode of the lateral vibration of the piezoelectric member 12 is a mode of vibration in the transverse direction of the diaphragm 3 (individual chamber 6) that is along the nozzle array direction NAD.

Specifically, in the head 100 according to present embodiment, the dimension of the piezoelectric member 12 is adjusted such that a static moment of area calculated from the dimension of the piezoelectric member 12 (laminated piezoelectric element) coincides with (or becomes larger than) the Helmholtz period of the nozzle 4. Thus, vibration (oscillation) of the natural period generated from the piezoelectric member 12 (laminated piezoelectric element) hardly affects the meniscus in the nozzle 4. Thus, the head 100 of the present embodiment has a uniform discharge characteristic. Particularly, the head 100 is hardly influenced by vibration (oscillation) caused by deviation of position of bonding between the piezoelectric member 12 and the diaphragm 3.

The above-described configuration is further described below with reference to the drawings.

Figure 6:
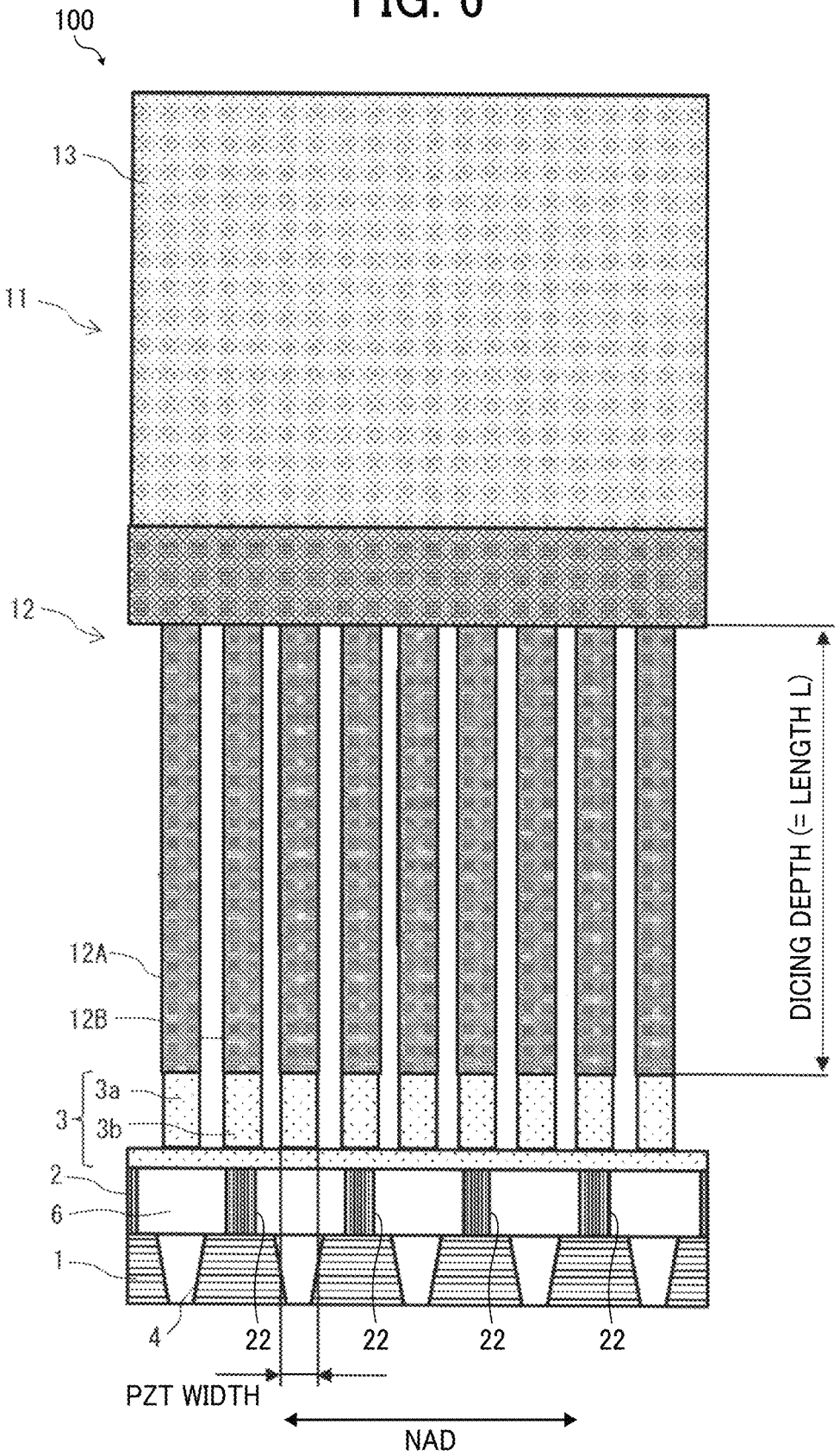
FIG. 6 is a partial cross-sectional view of the head along the nozzle array direction (transverse direction of individual chamber) according to another embodiment.
Figure 7:
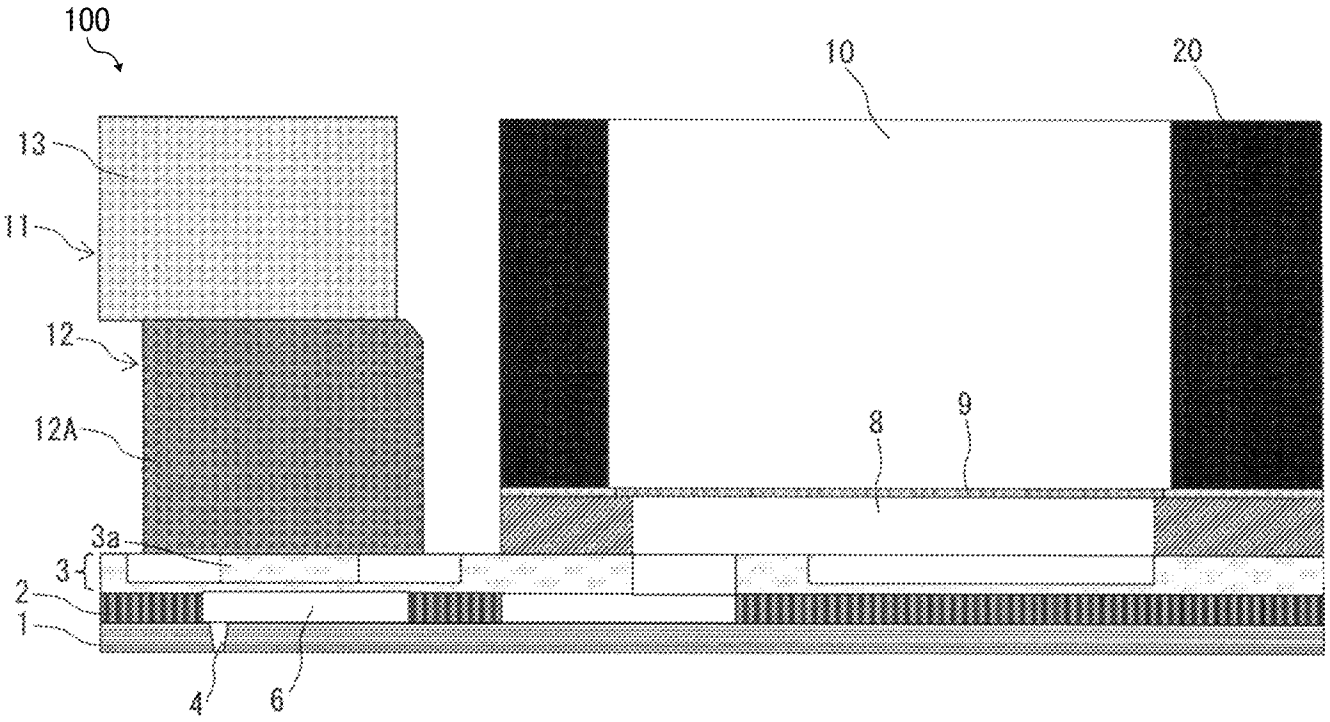
FIG. 7 is a partial cross-sectional view of the head of FIG. 6 in the longitudinal direction of the individual chamber.

Next, a length of a piezoelectric member 12 is described with reference to FIGS. 6 and 7. FIG. 6 is a partial cross-sectional view of the head of another example in the nozzle array direction NAD (transverse direction of the individual chamber). FIG. 7 is a cross-sectional view of the head of FIG. 6 in the longitudinal direction of the individual chamber. The same reference numerals are given to members similar to the members illustrated in FIGS. 1 to 3, and the explanation of which is omitted.

In FIGS. 6 and 7, it is assumed that the drive pillars 12A and the support pillars 12B are composed of pillars of lead zirconate titanate (PZT). In FIGS. 6 and 7, the pillars of the piezoelectric members 12 (support pillars 12B) are disposed at partition walls 22 of the individual chambers 6. However, the pillars of the piezoelectric members 12 (support pillars 12B) do not have to be provided to portions of the diaphragm 3 facing the partition walls 22.

In the following description, a dicing depth of the drive pillar 12A of the piezoelectric member 12 is referred to as a length "L" in FIG. 6. Further, a width of the drive pillar 12A along the nozzle array direction NAD (transverse direction of individual chamber) is referred to as a "PZT width".

The residual vibration of the meniscus was analyzed to design the head 100 that can stably discharge the liquid at high frequencies. A frequency different from the Helmholtz period was observed in the meniscus. Then, it was found that the discharge stability was deteriorated by the beat (oscillation) of this different frequency and the Helmholtz period of the meniscus. Thus, the meniscus at high frequencies varied and the discharge stability was deteriorated.

Figure 8:
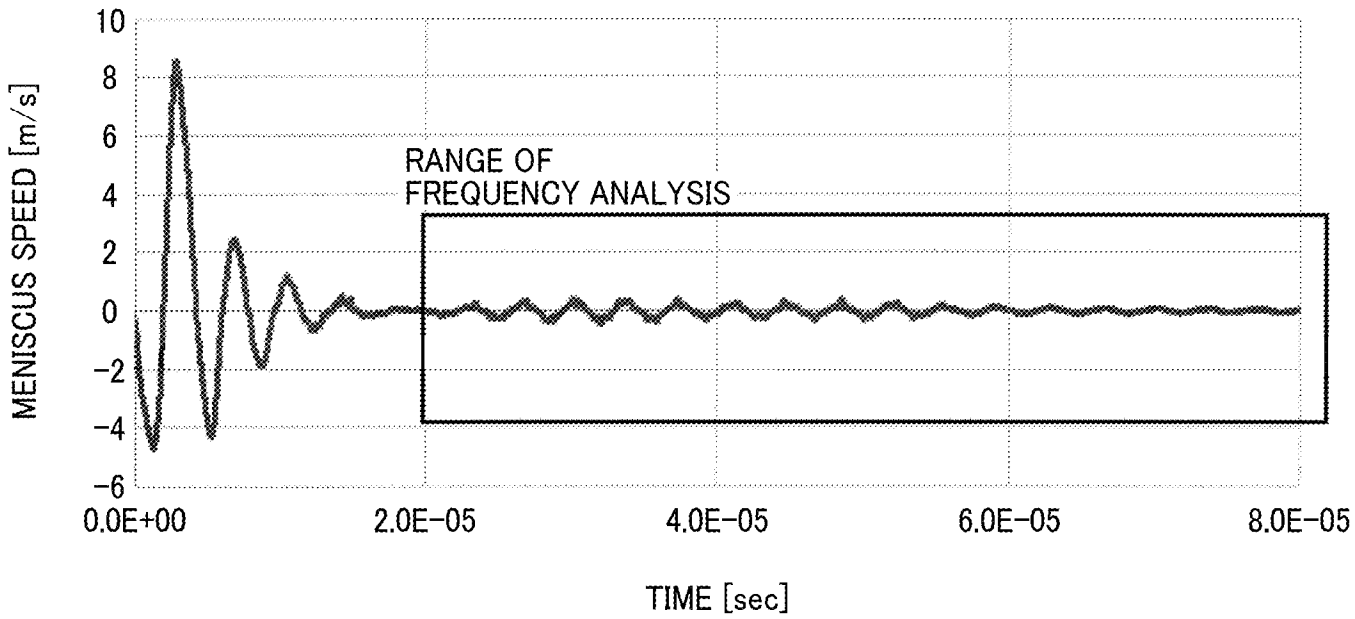
FIG. 8 is a graph illustrating an example of meniscus vibration of a nozzle.

FIG. 8 is a graph illustrating an example of a meniscus vibration of the nozzle. FIG. 8 illustrate measurement results of the meniscus vibration of the nozzle 4 by a laser doppler velocimeter (LDV) in a trapezoidal wave (pull waveform with peak value of 5 V). Among the measurement results, a range of a residual vibration portion (portion surrounded by a frame indicated in FIG. 8) is used for frequency analysis.

Figure 9:
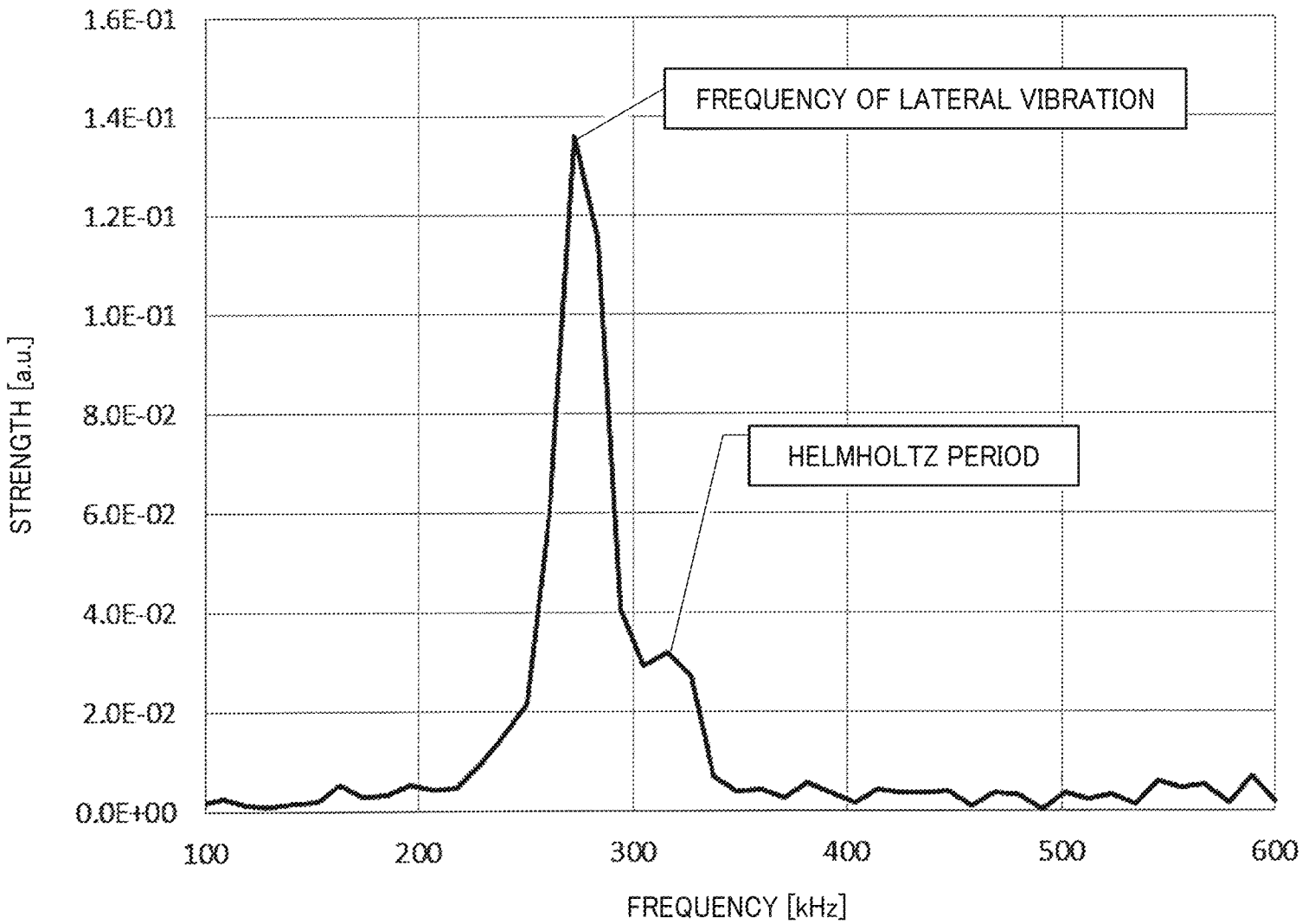
FIG. 9 illustrates a result of frequency dissolution of a range of residual vibration illustrated in FIG. 8 by Fourier transformation.

FIG. 9 illustrates the result of frequency decomposition of the frequency analysis for the range illustrated in FIG. 8 (portion surrounded by the frame in FIG. 8) by Fourier transformation. The Helmholtz period of the head 100 measured at this time is 3.2 μs (microseconds), which corresponds to the peak near 300 kHz in FIG. 9. There is another frequency peak at 270 kHz, which is the lateral vibration of the pillars (drive pillars 12A). The frequency peak at 270 kHz is almost equal to a value obtained by substituting a numerical value of the piezoelectric member 12 (laminated piezoelectric element) into Equation 1 described below.

Equation of natural vibration of beam — Equation 1

$$fn = \frac{kn^2}{2\pi}\sqrt{\frac{EI}{\rho AL^4}}$$

kn: Specific coefficient of the beam (4.73 for the beam fixing both ends)

E: Young's modulus

I: Sectional moment of inertia

A: Cross-sectional area

ρ: Density

L: length

At this time, the length "L" is equal to the dicing depth of the drive pillar 12A (PZT) in FIG. 6. The cross-sectional area A is equal to a product of the width (PZT width) of the drive pillar 12A multiplied by the dicing depth (length L).

The beat (oscillation) is formed such that the vibration at 2.0 E-05 sec in FIG. 8 disappears once by this lateral vibration.

A cycle of the primary mode of the lateral vibration of the piezoelectric member 12 (electromechanical transducer element) in the nozzle array direction NAD (transverse direction of the individual chamber 6) can be obtained from a known method such as calculation from a discharge speed of the liquid or calculation from the dimensions of the piezoelectric member 12 (electromechanical transducer element). For example, when the cycle of the primary mode is calculated from the discharge speed Vj, a value of a pulse height is fixed, and the pulse width applied to the piezoelectric member 12 (electromechanical transducer element) is changed. Then, the discharge speed varies according to the vibration of the meniscus.

Figure 10:
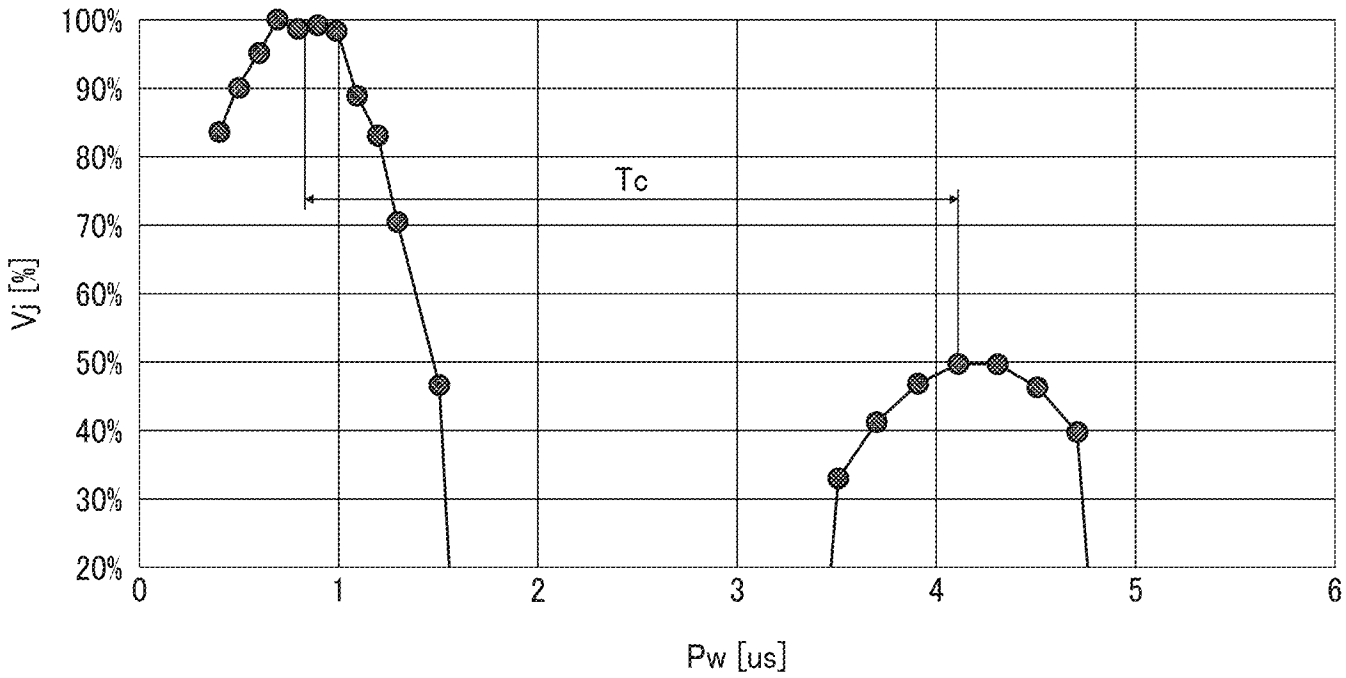
FIG. 10 is a graph illustrating a period of a primary mode of lateral vibration of an electromechanical transducer in the transverse direction of the individual chamber estimated by a discharge speed of a liquid.

Then, using the calculation described-above, a peak of the discharge speed Vj is observed, and time between the peaks of the discharge speed Vj roughly matches the period of the primary mode (Tc) when a pulse width Pw is plotted in the horizontal axis and the discharge speed Vj is plotted in the vertical axis (see FIG. 10).

FIG. 10 is a graph in which the pulse width Pw is plotted in the horizontal axis and the discharge speed Vj is plotted in the vertical axis. In this case, it can be estimated that the primary mode (Tc) is about 3.2 μs from FIG. 10.

Figure 11:
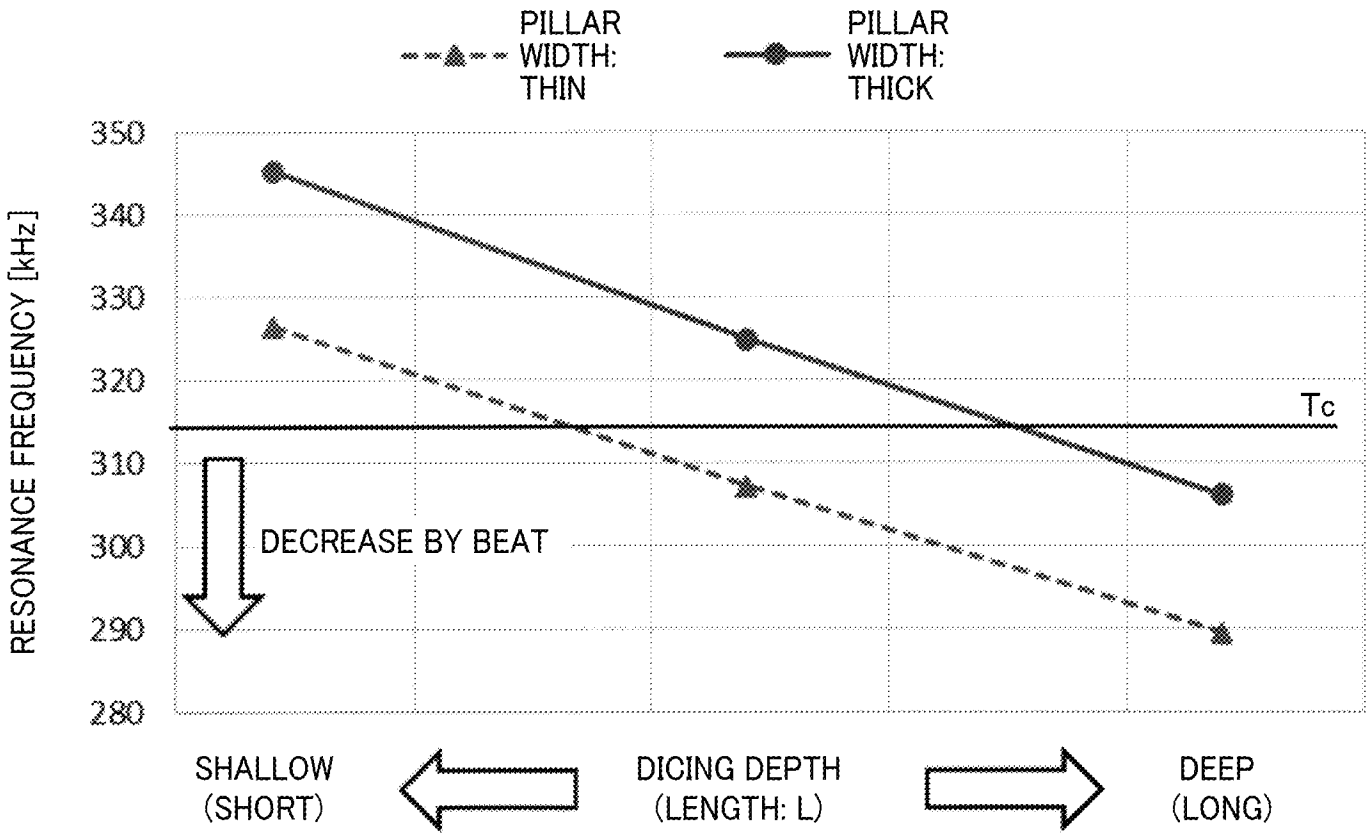
FIG. 11 is a graph illustrating a relation between the processed dimension of a lead zirconate titanate (PZT) and a natural vibration period according to Equation 1.

FIG. 11 is a graph illustrating a resonance frequency of the drive pillar 12A and a dicing depth (length L) of the drive pillar 12A when the PZT width (pillar width) and the dicing depth (length L) of the pillar (drive pillar 12A) are varied based on Equation 1.

The resonance frequency of the drive pillar 12A increases (cycle decreases) by making the drive pillar 12A thick (circle in FIG. 11) and short (shallow in FIG. 11).

If the resonance frequency of the drive pillar 12A is equal to or higher than Tc (the Helmholtz frequency of the meniscus), the cycle of the beat increases. Thus, the influence of the beat decreases due to attenuation of an amplitude of the beat during one cycle of the beat. Further, when the resonance frequency of the drive pillar 12A is higher than Tc (cycle is short), the length of the drive pillar 12A is short (shallow) and the width of the drive pillar 12A is thick as a structure (upper left in FIG. 11). Thus, the drive pillar 12A having short length and thick width can prevent the vibration (oscillation) of the piezoelectric member 12, and the rigidity of the piezoelectric member 12 increases. Therefore, a speed of the attenuation of the lateral vibration of the drive pillar 12A also increases, and the influence of the lateral vibration of the drive pillar 12A decreases. Conversely, when the resonance frequency of the drive pillar 12A is lower than Tc (cycle is long), the influence of the beat increases. Thus, the drive pillar 12A having long length and thin width is not suitable as the piezoelectric member 12 for the head 100.

Figure 12:
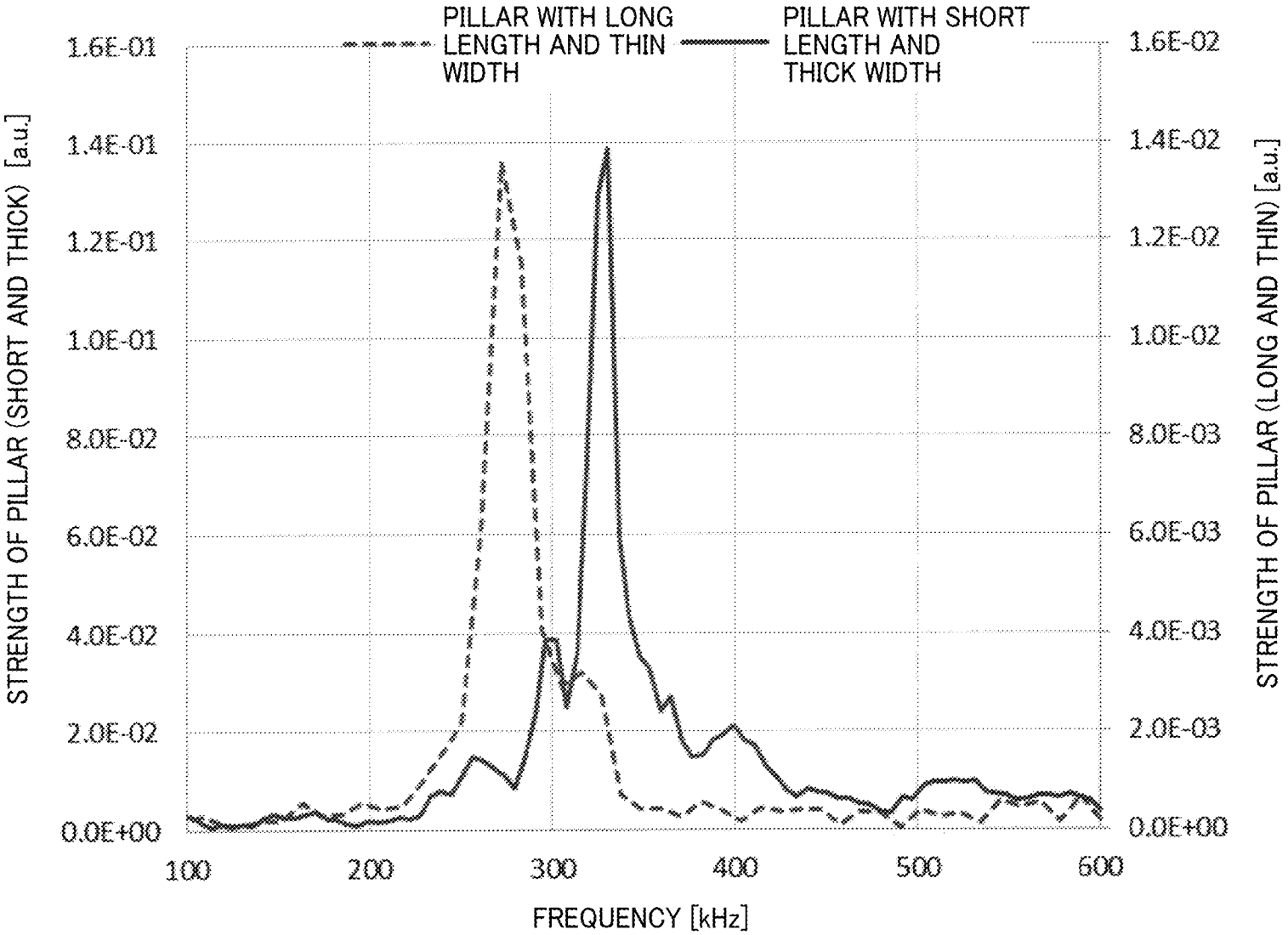
FIG. 12 is a graph illustrating a frequency distribution of residual vibration due to dimensional change of a pillar.

FIG. 12 is a graph illustrating a relation between a frequency distribution of the residual vibration of the meniscus in the nozzle and a strength of the pillar. FIG. 12 illustrate a result of comparison between the drive pillar 12A with short length and thick width and the drive pillar 12A with long length and thin width. In the comparison of the residual vibration of the meniscus of the liquid in the nozzle 4 in FIG. 12, the dotted line illustrates the drive pillar 12A with long length and thin width, and the solid line illustrates the drive pillar 12A with short length and thick width.

As illustrated in FIG. 12, a peak position of the frequency of the residual vibration of the drive pillar 12A with short length and thick width is higher than a peak position of the frequency of the residual vibration of the drive pillar 12A with long length and thin width.

Figure 13:
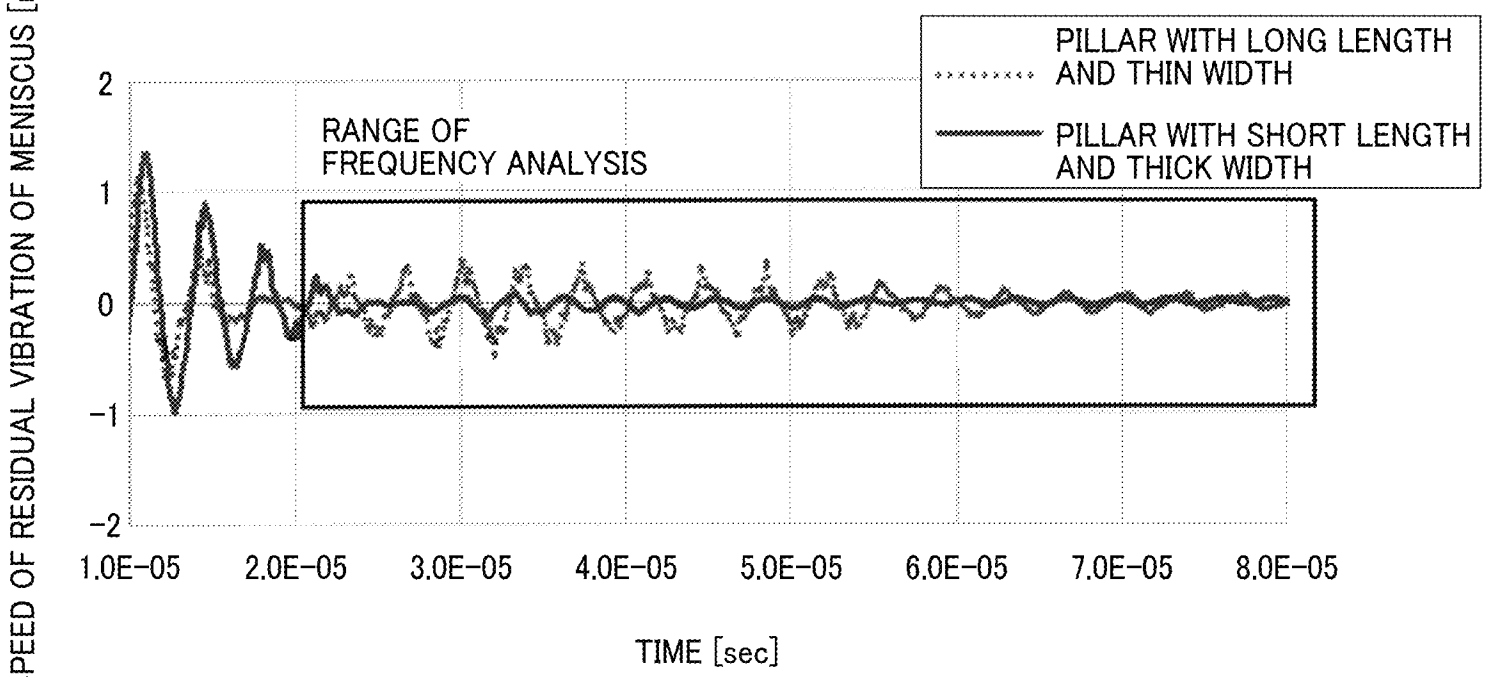
FIG. 13 is a graph illustrating a comparison result of the residual vibration of the meniscus due to dimensional change of the pillar.

FIG. 13 is a graph illustrating a speed of residual vibration of the meniscus in the nozzle and time. FIG. 13 illustrate a result of comparison of the speed of residual vibration of the meniscus of the liquid in the nozzle 4 between the drive pillar 12A with short length and thick width and the drive pillar 12A with long length and thin width. As illustrated in FIG. 13, the attenuation of the residual vibration of the meniscus of the drive pillar 12A with short length and thick width is faster than the attenuation of the residual vibration of the meniscus of the drive pillar 12A with long length and thin width. Further, the beat is substantially prevented in the drive pillar 12A with short length and thick width.

Thus, the drive pillar 12A with short length and thick width can stabilize the residual vibration of the meniscus and stably discharge the liquid even when the piezoelectric member 12 (drive pillar 12A) is driven at high frequency.

As described above, the head 100 according to the present embodiment can reduce the variations in discharge characteristics by regulating the dimension of the piezoelectric member 12, specifically, the length and the thickness of the piezoelectric member 12 (drive pillar 12A) in the head 100. Thus, the head 100 according to the present embodiment can make the discharge characteristics of the head 100 uniform. The head 100 of the present embodiment has a shape in which the individual chamber 6 is long in the direction perpendicular to the nozzle array direction NAD (longitudinal direction of the individual chamber 6). Further, in the head 100 of the present embodiment, a cycle of vibration of the natural vibration excited in the liquid (ink) in the individual chamber 6 is larger than a cycle of the primary mode of the lateral vibration of the piezoelectric member 12 in the transverse direction of the individual chamber 6 (in the nozzle array direction NAD). The natural vibration excited in the liquid (ink) in the individual chamber 6 is the Helmholtz period depending on physical properties of the ink.

Thus, the drive pillar 12A according to the present embodiment can improve variations due to frequency characteristics generated between adjacent nozzles or the like. Thus, the head 100 of the present embodiment has uniform discharge characteristic.

Further, the diaphragm 3 serving as a vibration plate preferably includes island-shaped convex portions 3*a* and 3*b*. Further, the diaphragm 3 is preferably bonded (preferably, fixed by joint) to the drive pillars 12A serving as the electromechanical transducer element at the convex portion 3*a* of the diaphragm 3. Forming the diaphragm 3 having an island-like structure can prevent propagation of the vibration of the drive pillar 12A to adjacent channels via the partition walls. Thus, the head 100 of the present embodiment can reduce stably and uniformly discharge the liquid.

Further, the head 100 of the present embodiment preferably includes the support pillars 12B serving as a support structure at positions corresponding to the partition walls on a bonding surface of the diaphragm 3 at which the diaphragm 3 is joined (bonded) to the piezoelectric member 12 (electromechanical transducer element). Thus, the head 100 of the present embodiment including the support structure (support pillar 12B) can increase the rigidity of the piezoelectric member 12. Thus, the head 100 of the present embodiment can increase the speed of attenuation of the lateral vibration of the piezoelectric member 12 (drive pillar 12A).

Next, a liquid discharge apparatus according to the present embodiment is described with reference to FIGS. 14 and 15.

In the present embodiment, discharged liquid is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

A "liquid discharge device" is an integrated unit including the head and a functional part(s) or unit(s) and is an assembly of parts relating to liquid discharge. For example, the "liquid discharge device" includes a combination of the head with at least one of a head tank, a carriage, a supply unit, a maintenance unit, and a main scan moving unit.

Examples of the integrated unit include a combination in which the head and one or more functional parts and devices are secured to each other through, e.g., fastening, bonding, or engaging, and a combination in which one of the head and the functional parts and devices is movably held by another. Further, the head, the functional parts, and the mechanism may be configured to be detachable from each other.

For example, the head and the head tank may form the liquid discharge device as a single unit. Alternatively, the head and the head tank coupled (connected) with a tube or the like may form the liquid discharge device as a single unit. A unit including a filter may be added at a position between the head tank and the head of the liquid discharge device.

The head and the carriage may from the liquid discharge device as a single unit.

In still another example, the liquid discharge device includes the head movably held by a guide that forms part of a main-scanning moving unit, so that the head and the main-scanning moving unit form a single unit. The liquid discharge device may include the head, the carriage, and the main scan moving unit that form a single unit.

In still another example, the cap that forms part of the maintenance unit is secured to the carriage mounting the head so that the head, the carriage, and the maintenance unit form a single unit to form the liquid discharge device.

Further, in still another example, the liquid discharge device includes tubes connected to the head tank or the head mounting a channel member so that the head and the supply unit form a single unit. Through this tube, the liquid of the liquid storage source such as an ink cartridge is supplied to the head.

The main scan moving unit may be a guide only. The supply unit may be a tube(s) only or a loading unit only.

The term "liquid discharge apparatus" used herein also represents an apparatus including the head or the liquid discharge device to discharge liquid by driving the head.

The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus includes an apparatus to form meaningless images, such as meaningless patterns, or fabricate three-dimensional images.

The above-described term "material on which liquid adheres" represents a material on which liquid is at least temporarily adhered, a material on which liquid is adhered and fixed, or a material into which liquid is adhered to permeate. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material on which liquid adheres unless particularly limited.

The above-mentioned "material to which liquid adheres" may be any material as long as liquid can temporarily adhere such as paper, thread, fiber, cloth, leather, metal, plastic, glass, wood, ceramics, or the like.

The "liquid discharge apparatus" may be an apparatus to relatively move the head and a material on which liquid can be adhered. However, the liquid discharge apparatus is not limited to such an apparatus. For example, the "liquid discharge apparatus" may be a serial head apparatus that moves the head, a line head apparatus that does not move the head, or the like.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

Next, a liquid discharge apparatus according to an embodiment of the present disclosure is described with reference to FIGS. 14 and 15. FIG. 14 is a side view of an entire configuration of a mechanical section of the liquid discharge apparatus. FIG. 15 is a plan view of a portion of the liquid discharge apparatus. In the present embodiment, an image forming apparatus 1000 (printer) is described as an example of the liquid discharge apparatus, but the present embodiment is not limited to the image forming apparatus.

Figure 14:
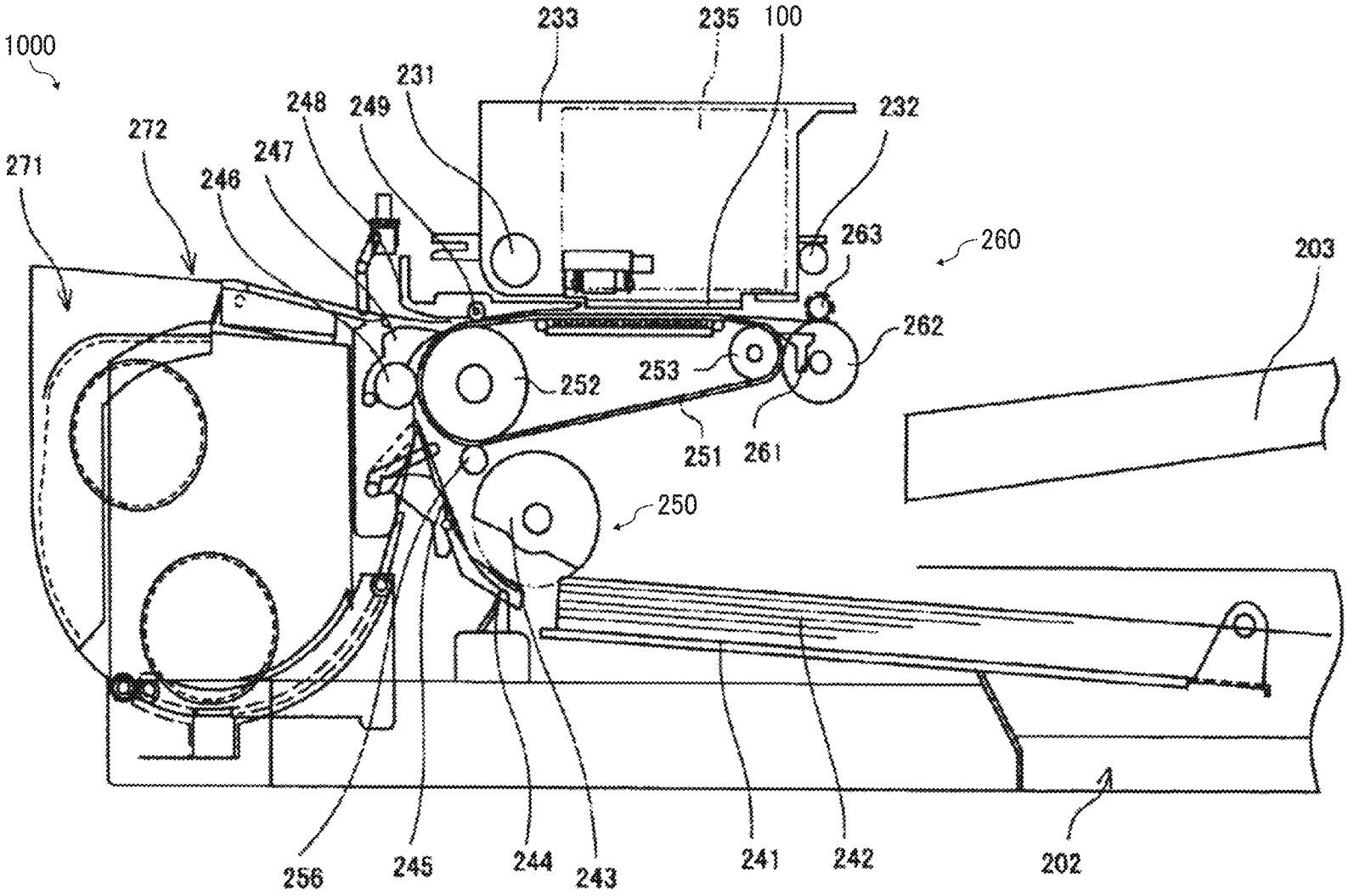
FIG. 14 is a side view of an entire structure of an image forming apparatus according to an embodiment of the present disclosure.
Figure 15:
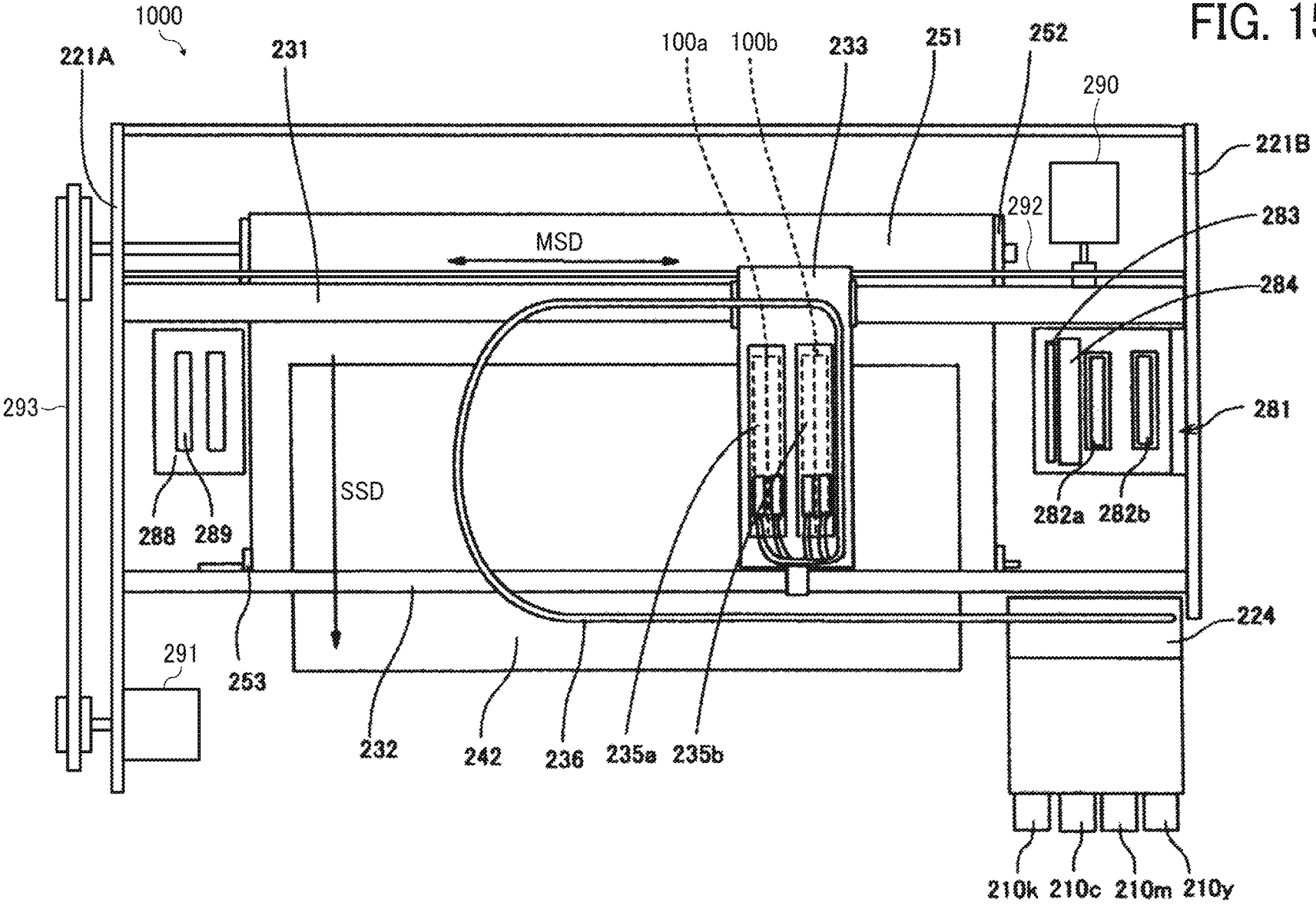
FIG. 15 is an exploded plan view of the image forming apparatus of FIG. 14.

The image forming apparatus 1000 in FIGS. 14 and 15 is a serial type image forming apparatus, and slidably holds a carriage 233 in a main scanning direction MSD by primary guide rod 231 and a secondary guide rod 232 which are guide members lateral bridged between a left side plate 221A and a right-side plate 221B. The main scanning motor 290 moves and scans the carriage 233 in the main scanning direction indicated by arrow MSD in FIG. 15 via a timing belt 292.

The heads 100*a* and 100*b* to discharge ink droplets (liquids) of respective colors of yellow (Y), cyan (C), magenta (M), and black (Bk) are mounted on the carriage 233 so that a plurality of nozzles 4 of each nozzle arrays 4*a* and 4*b* is arranged in the nozzle array direction NAD (see FIG. 1). Here, the nozzle array direction NAD of the heads 100*a* and 100*b* is arranged in a sub-scanning direction (indicated by arrow SSD) perpendicular to the main scanning direction MSD. The heads 100*a* and 100*b* are mounted on the carriage 233 in such a direction that ink droplets are discharged downward.

The image forming apparatus 1000 includes two heads 100*a* and 100*b* each having two nozzle arrays 4*a* and 4*b* (see FIG. 1) mounted on a base member. One of the nozzle array 4*a* of one head 100*a* discharges the ink droplets of black (K), and the other nozzle array 4*b* discharges the ink droplets of cyan (C). Further, one nozzle array 4*a* of the other head 100*b* discharges the ink droplets of magenta (M), and the other nozzle array 4*b* discharges the ink droplet of yellow (Y). In FIG. 15, the image forming apparatus 1000 includes two heads 100*a* and 100*b* to discharge liquid droplets of four colors. Thus, each of the heads 100 discharges liquids of two colors. Further, the image forming apparatus 1000 may include the head 100 for each colors, that is, four one head 100 for one color.

The carriage 233 mounts sub tanks 235*a* and 235*b* that supply ink of four colors to the heads 100*a* and 100*b* to discharge the ink of four colors from the corresponding one of the nozzle arrays 4*a* and 4*b*. The sub tanks 235*a* and 235*b* are simply referred as the sub tanks 235. The supply unit 224 supplies ink of four colors to the sub tank 235 from the ink cartridges 210*k*, 210*c*, 210*m*, and 210*y* via the via supply tubes 236 of the four colors.

The image forming apparatus 1000 further includes a sheet feeder 250 to feed sheets 242 stacked on a sheet stacker 241 of a sheet feed tray 202. The sheet feeder 250 includes a sheet feed roller 243 and a separation pad 244. The sheet feed roller 243 has a semicircular shape and separates and feeds the sheets 242 one by one from the sheet stacker 241. The separation pad 244 is disposed opposite to the sheet feed roller 243 and is made of material having a large friction coefficient. The separation pad 244 is pushed against the sheet feed roller 243.

The image forming apparatus 1000 further includes a guide 245 to guide the sheet 242 fed from the sheet feeder 250 to a position below the heads 100, a counter roller 246, a conveyance guide 247, and a pressure member 248 provided with a leading end pressing roller 249. The image forming apparatus 1000 further includes a conveyance belt 251 as a sheet conveyor to attract the sheet 242 fed by the sheet feeder 250 and convey the sheet 242 at a position opposite the heads 100. The conveyance belt 251 attracts the sheet by an electrostatic force, for example.

The conveyance belt 251 is an endless belt and is wound around a conveyance roller 252 and a tension roller 253 so as to circle in the belt conveyance direction (sub-scanning direction SSD). The image forming apparatus 1000 further includes a charge roller 256 for charging an outer surface of the conveyance belt 251. The charge roller 256 contacts a surface layer of the conveyance belt 251 and is rotate following the rotation of the conveyance belt 251. The conveyance belt 251 is rotated in the belt conveyance direction by rotation of the conveyance roller 252 through timing belt 293 by a sub-scanning motor 291.

The image forming apparatus 1000 further includes a separation claw 261 to separate the sheet 242 from the conveyance belt 251, ejection rollers 262 and 263, and an ejection tray 203 positioned below the ejection roller 262 as an ejection unit 260 to eject the sheet 242 onto which the ink is discharged from the heads 100.

Further, the image forming apparatus 1000 includes a duplex-printing unit 271 detachably attached to a back side of the image forming apparatus 1000. The duplex-printing unit 271 draws the sheet 242 sent back by reverse rotation of the conveyance belt 251 into the duplex-printing unit 271. Then, the duplex-printing unit 271 reverses the sheet 242 and conveys the sheet 242 toward the counter roller 246 again. An upper surface of the duplex-printing unit 271 serves as a bypass tray 272.

Further, the image forming apparatus 1000 includes a maintenance unit 281 for maintaining and recovering a state of the nozzles 4 of the heads 100 in a non-printing area on one side in the main scanning direction MSD of the carriage 233, The maintenance unit 281 includes caps 282*a* and 282*b* to cap each nozzle surfaces 1*a* of the heads 100 and a wiper blade 283 to wipe each nozzle surfaces 1*a*, and a dummy discharge receptacle 284 to receive the ink discharged by a dummy discharge in which ink not contributing to image formation is discharged by the heads 100 to discharge thickened ink. The caps 282*a* and 282*b* are referred to as "cap 282" when not specifically distinguished.

Further, the image forming apparatus 1000 includes a dummy discharge receptacle 288 to receive the ink discharged by the dummy discharge that do not contribute to image formation to discharge thickened ink during image formation, for example, in the non-printing area at the other end in the main scanning direction MSD of the carriage 233. The dummy discharge receptacle 288 includes opening 289 extending along the nozzle array direction NAD (sub-scanning direction SSD) of the heads 100 in which nozzles 4 are arrayed in rows.

In the image forming apparatus 1000 thus configured, the sheet 242 is separated and fed substantially vertically upward from the sheet feed tray 202 one by one, guided by the guide 245, and conveyed while being nipped between the conveyance belt 251 and the counter roller 246. A leading end of the sheet 242 is guided by the conveyance guide 247 and pressed against the conveyance belt 251 by the leading end pressing roller 249. Thus, the conveyance direction of the sheet 242 is turned substantially 90°.

At this time, a positive output and a negative output are alternately repeated, that is, an alternating voltage is applied from an AC bias supplier of the controller to the charge roller 256, and the conveyance belt 251 is charged in an alternating charge voltage pattern, that is, alternately charged plus and minus in a band manner with a predetermined width in the sub-scanning direction SSD that is a circulating direction of the conveyance belt 251. When the sheet 242 is fed onto the conveyance belt 251 alternately charged positive and negative, the sheet 242 is attracted by the conveyance belt 251 and is conveyed in the sub-scanning direction SSD by circular movement of the conveyance belt 251.

Then, the head 100 is driven according to an image signal while the carriage 233 is moved in the main scanning direction MSD, and the ink droplets are discharged onto the stopped sheet 242 to record one line and then the next line is recorded after conveyance of the sheet 242 by a predetermined amount. Receiving a recording end signal or a signal indicating that the rear end of the sheet 242 has arrived at the recording area, the recording operation finishes and the sheet 242 is ejected to the ejection tray 203.

As described above, the image forming apparatus 1000 includes the head 100 according to the present embodiment has uniform discharge characteristics, thus allowing stable formation of high quality images.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge head, comprising:

a nozzle plate in which a plurality of nozzles to discharge a liquid is formed in a nozzle array direction;

a channel plate including partition walls to form a plurality of individual chambers communicating with the plurality of nozzles, respectively;

a diaphragm bonded to the channel plate to form a wall of the plurality of individual chambers; and a plurality of electromechanical transducers bonded to the diaphragm to deform the diaphragm to generate a pressure in the plurality of individual chambers, wherein a longitudinal direction of the plurality of individual chambers is disposed in a direction perpendicular to the nozzle array direction, and the plurality of electromechanical transducers have physical dimensions that are set so that a cycle of vibration generated in the liquid in the plurality of individual chambers is equal to or larger than a cycle of a primary mode of lateral vibration of the plurality of electromechanical transducers in the nozzle array direction.

2. The liquid discharge head according to claim 1, wherein the physical dimensions of the plurality of electromechanical transducers are further set so that a frequency of the primary mode of the lateral vibration of the plurality of electromechanical transducers in the nozzle array direction is equal to or larger than a frequency of vibration of the vibration generated in the liquid in the plurality of individual chambers.

3. The liquid discharge head according to claim 1, wherein the diaphragm includes a plurality of convex portions, and the plurality of electromechanical transducers is bonded to the plurality of convex portions, respectively.

4. The liquid discharge head according to claim 1, further comprising a plurality of supports at positions corresponding to the partition walls on a bonding surface of the diaphragm at which the diaphragm is bonded to the plurality of electromechanical transducers.

5. A liquid discharge apparatus comprising the liquid discharge head according to claim 1.

6. The liquid discharge head of claim 1, wherein the physical dimensions of each of the plurality of electromechanical transducers, including a length and a width, are set so that the cycle of vibration generated in the liquid in the plurality of individual chambers is equal to or larger than the cycle of a primary mode of lateral vibration of the plurality of electromechanical transducers in the nozzle array direction.

* * * * *